US011685012B2

(12) United States Patent
Trojan

(10) Patent No.: US 11,685,012 B2
(45) Date of Patent: Jun. 27, 2023

(54) PLANARIZED MEMBRANE AND METHODS FOR SUBSTRATE PROCESSING SYSTEMS

(71) Applicant: AXUS TECHNOLOGY, LLC, Chandler, AZ (US)

(72) Inventor: Daniel Ray Trojan, Chandler, AZ (US)

(73) Assignee: Axus Technology, LLC, Chandler, AZ (US)

( * ) Notice: Subject to any disclaimer, the term of this patent is extended or adjusted under 35 U.S.C. 154(b) by 375 days.

(21) Appl. No.: 16/758,794

(22) PCT Filed: Oct. 29, 2018

(86) PCT No.: PCT/US2018/058024

§ 371 (c)(1),
(2) Date: Apr. 23, 2020

(87) PCT Pub. No.: WO2019/089467

PCT Pub. Date: May 9, 2019

(65) Prior Publication Data

US 2021/0178548 A1 Jun. 17, 2021

Related U.S. Application Data

(60) Provisional application No. 62/582,187, filed on Nov. 6, 2017.

(51) Int. Cl.
*B24B 37/04* (2012.01)

(52) U.S. Cl.
CPC ..... *B24B 37/042* (2013.01)

(58) Field of Classification Search
None
See application file for complete search history.

(56) References Cited

U.S. PATENT DOCUMENTS

| | | | | |
|---|---|---|---|---|
| 5,885,137 | A | 3/1999 | Ploessl | |
| 6,855,043 | B1 | 2/2005 | Tang et al. | |
| 8,348,720 | B1 | 1/2013 | Ko | |
| 10,201,887 | B2 * | 2/2019 | Chen | B24B 37/30 |
| 2001/0001301 | A1 | 5/2001 | Gurusamy et al. | |
| 2001/0039169 | A1 | 11/2001 | Brown | |
| 2007/0111637 | A1 | 5/2007 | Togawa et al. | |

(Continued)

FOREIGN PATENT DOCUMENTS

| | | | |
|---|---|---|---|
| EP | 0 887 151 | A2 | 12/1998 |
| EP | 1 066 923 | A2 | 1/2001 |

(Continued)

OTHER PUBLICATIONS

Extended European Search Report received in EP 18873683.9 dated Jul. 15, 2021.

(Continued)

*Primary Examiner* — Long Pham
(74) *Attorney, Agent, or Firm* — Knobbe, Martens, Olson & Bear, LLP

(57) ABSTRACT

A method and a system for planarizing a membrane is disclosed. In one aspect, the method includes providing a resilient membrane and planarizing the surface of the membrane with a conditioning tool. The planarized membrane may be used in chemical mechanical planarization of a wafer. The method further includes finishing the surface of a wafer with the planarized membrane.

26 Claims, 8 Drawing Sheets

(56) References Cited

U.S. PATENT DOCUMENTS

| | | | |
|---|---|---|---|
| 2007/0141954 | A1 | 6/2007 | Chen et al. |
| 2009/0242125 | A1 | 10/2009 | Paik et al. |
| 2016/0129547 | A1 | 5/2016 | Duescher et al. |

FOREIGN PATENT DOCUMENTS

| | | |
|---|---|---|
| JP | H09-57587 | 3/1997 |
| JP | 2001-54855 | 2/2001 |
| JP | 2001-219368 | 8/2001 |
| JP | 2015-223681 | 12/2015 |

OTHER PUBLICATIONS

International Search Report & Written Opinion from related App. PCT/US18/58024 dated Jan. 15, 2019 (12 pgs).

* cited by examiner

PLANARIZED MEMBRANE AND METHODS FOR SUBSTRATE PROCESSING SYSTEMS

INCORPORATION BY REFERENCE TO ANY PRIORITY APPLICATIONS

This application is a utility application claiming the benefit of the earlier filing date of provisional application Ser. No. 62/582,187 filed Nov. 6, 2017 which is hereby incorporated by reference in its entirety.

BACKGROUND

Field

This disclosure is generally related to a method and device for improving chemical mechanical planarization (CMP) performance for the planarization of thin films using wafer carriers with planarized membranes.

Description of the Related Technology

During chemical mechanical planarization or polishing (CMP), an abrasive and either acidic or alkalinic slurry is applied via a metering pump or mass-flow-control regulator system onto a rotating polishing pad/platen. A substrate or wafer is held by a wafer carrier which is rotated and pressed against a polishing platen for a specified period of time. The slurry is normally brought to the polishing platen in a single-pass distribution system. The wafer is polished or planarized by both abrasion and corrosion during the CMP process.

The slurry particles in their media may not be distributed evenly between the rotating wafer and the rotating polishing pad/platen. At least some of the polishing slurry may not be effective nor productive because it is swept to the edge of the polishing pad/platen by centrifugal force, and also by the "squeegee" action of the wafer against the polishing pad/platen. Particles that do not contact the wafer surface don't contribute to planarization and are wasted, increasing cost and reducing efficiency of the CMP process. Aspects of the pad, such as its hydrophobic nature, contribute to variations in the distribution of the slurry and its sub-micron abrasive particles and corrosive chemicals.

There is a need to improve the slurry and pad performance to increase CMP efficiency and reduce the cost of manufacturing.

SUMMARY

One aspect of the disclosed technology is a method for processing a resilient membrane for a substrate carrier. The method includes providing the resilient membrane, and planarizing a surface of the resilient membrane to form a planarized resilient membrane.

Another aspect of the disclosed technology is an apparatus for supporting a substrate. The apparatus includes a membrane comprising a planarized surface, a support plate configured to support the membrane, and a holding element configured to hold the membrane to the support plate.

Another aspect of the disclosed technology is a membrane for chemical mechanical planarization. The membrane includes a resilient membrane body comprising a substrate facing surface and a carrier facing surface, wherein the substrate facing surface is planarized.

BRIEF DESCRIPTION OF THE DRAWINGS

The above, as well as additional objects, features and advantages of the present inventive concept, will be better understood through the following illustrative and non-limiting detailed description of embodiments of the present invention, with reference to the appended drawings. In the drawings like reference numerals will be used for like elements unless stated otherwise.

DETAILED DESCRIPTION OF CERTAIN ILLUSTRATIVE EMBODIMENTS

Figure 1:
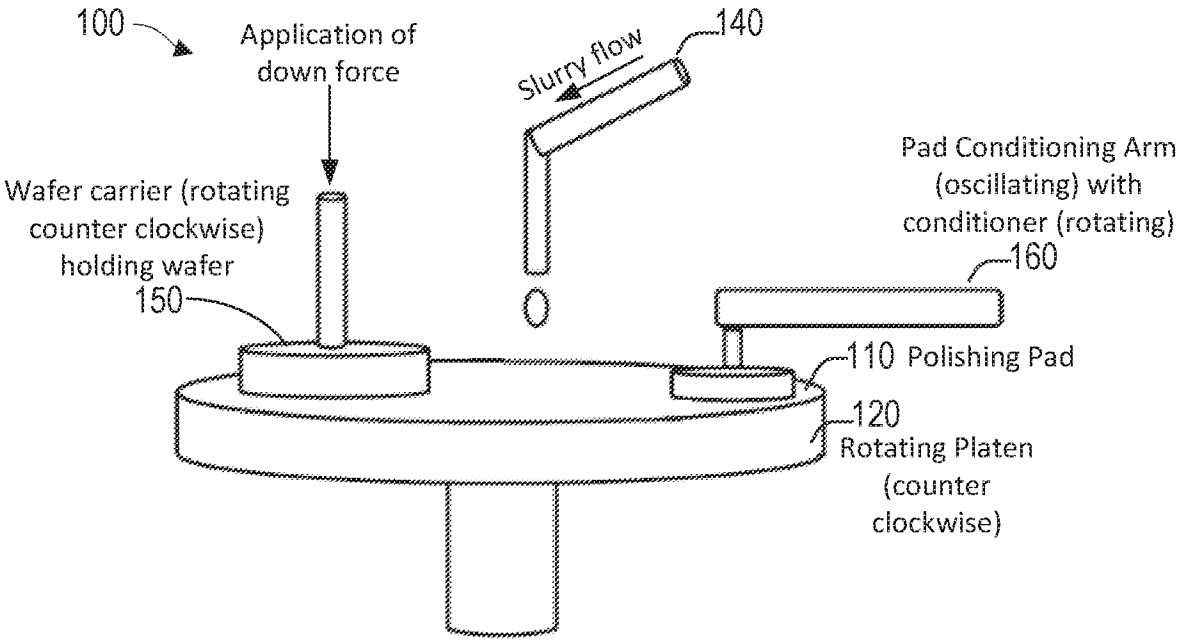
FIG. 1 is a schematic illustration of a chemical mechanical planarization system, showing a substrate carrier holding a substrate in a processing position.

Although the following text sets forth a detailed description of numerous different embodiments of the invention, it should be understood that the legal scope of the invention is defined by the words of the claims set forth at the end of the patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

The word "exemplary" is used herein to mean "serving as an example, instance, or illustration." Any aspect or embodiment described herein as "exemplary" is not necessarily to be construed as preferred or advantageous over other aspects or embodiments. Various aspects of the novel systems, apparatuses, and methods are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of, or combined with, any other aspect described. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosures set forth herein. It should be understood that any aspect disclosed herein may be embodied by one or more elements of a claim.

It should also be understood that, unless a term is expressly defined in this patent using the sentence "As used herein, the term ' ' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning.

Chemical Mechanical Planarization (CMP)

The adoption and use of chemical mechanical planarization (CMP) for the planarization of thin films in the manufacture of semiconductor ICs, MEMS devices, and LEDs, among many other similar applications, is common among companies manufacturing "chips" for these types of devices. This adoption includes the manufacture of chips for mobile telephones, tablets and other portable devices, plus desktop and laptop computers. The growth in nanotechnology and micro-machining holds great promise for ever-widespread use and adaptation of digital devices in the medical field, in the automotive field, and in the Internet of Things (the "IoT"). Chemical mechanical planarization for the planarization of thin films was invented and developed in the early 1980's by scientists and engineers at the IBM Corporation. Today, this process is widespread on a global basis and is one of the truly enabling technologies in the manufacture of many digital devices.

Integrated circuits are manufactured with multiple layers and alternating layers of conducting materials (e.g., copper, tungsten, aluminium, etc.), insulating layers (e.g., silicon dioxide, silicon nitride, etc.), and semiconducting material (e.g., polysilicon). A successive combination of these layers is sequentially applied to the wafer surface, but because of the implanted devices on the surface, topographical undulations are built up upon the device structures, as is the case with silicon dioxide insulator layers. These unwanted topographical undulations are often flattened or "planarized" before the next layer can be deposited, to allow for proper interconnect between device features of ever decreasing size. In the case of copper layers, the copper is deposited on the surface to fill contact vias and make effective vertical paths for the transfer of electrons from device to device and from layer to layer. This procedure continues with each layer that is applied (usually applied by a deposition process). In the case of multiple layers of conducting material (multiple layers of metal), this could result in numerous polishing procedures (one for each layer of conductor, insulator, and semiconductor material) in order to achieve successful circuitry and interconnects between device features.

The CMP process is an enabling technology in the manufacture of multi-layer circuitry that makes this all possible.

A major cost contributor in the CMP process is made up of the collective costs associated with the consumable set, such as the polishing slurries, the polishing pads and the wafer carrier membranes. The polishing slurries are typically colloidal suspensions of abrasive particles, i.e. colloidal silica, colloidal alumina, or colloidal ceria, in a water based medium.

The polishing pads are typically polyurethane based. The typical CMP polishing pad is usually from 18" to 24" in diameter; this dimension dictated by the size of the polishing platen (table) on the popular polishing machines in use around the world. However, in some applications they may be larger in diameter even up to 48" and larger (precision optical applications for example). These polishing pads are attached to a very flat polishing platen (polishing table) by pressure sensitive adhesive.

Modern CMP carriers typically incorporate certain components for precision polishing of generally flat and round workpieces such as silicon wafers and/or films deposited on them. These components include: 1) a resilient membrane consisting of one or more separate zones, with compressed gas applied to the top surface or back side of the membrane; said pressure is then transmitted via the membrane to the top surface or back side of the workpiece in order to effect the material removal during CMP; 2) one or more rigid support components which provide means for: fastening the membrane to its mating components, holding the membrane to its desired shape and dimension, and/or clamping the membrane to provide a sealed volume for sealing and containing the controlled gas pressure.

During the CMP process, the slurry is applied via a metering pump or mass-flow-control regulator system onto the rotating polishing pad. The substrate or wafer is held by a wafer carrier which is rotated and pressed, generally via a resilient membrane within the wafer carrier, against the polishing platen for a specified period of time. The slurry is normally brought to the polishing platen in a single-pass distribution system. The normal expectation is that the slurry particles in their media will be distributed evenly between the rotating wafer, and the rotating polishing pad/platen.

A force is applied to the backside of the wafer by the wafer carrier membrane to press it into the pad and both may have motion to create a relative velocity. The motion and force leads to portions of the pad creating abrasion by pushing the abrasive against the substrate while it moves across the wafer surface. The corrosive chemicals in the slurry alter the material being polished on the surface of the wafer. This mechanical effect of abrasion combined with chemical alteration is called chemical mechanical planarization or polishing (CMP). The removal rate of the material can be easily an order of magnitude higher with both the chemical and mechanical effects simultaneously compared to either one taken alone. Similarly, the smoothness of the surface after polishing is also optimized by using chemical and mechanical effects together.

During the polishing process, material such as copper, a dielectric, or polysilicon is removed from the surface of the wafer. These microscopic particles either remain in suspension in the slurry or become embedded in the polishing pad or both. These particles cause scratches on the surface of the film being polished, and thus catastrophic failures in the circuitry rendering the chip useless, thus becoming a major negative effect upon yield.

Yield is the driving force in determining success at the manufacturing level for many products including integrated circuits, MEMS, and LEDs. The surface quality tolerances for a CMP process within semiconductor manufacturing facilities ("fabs") and foundries are measured in nanometers and even Angstroms. The ability to remove material as uniformly as possible from the surface of a wafer or film during CMP is important. Therefore, carrier design technology is constantly evolving toward improving this capability. Small non-uniformities in the flatness of a wafer that has been processed in a CMP system can result in decreased yield and increased waste. The accumulated costs of manufacturing a solid state device are together termed the "Costof-Ownership" (CoO) and this term is also applied to each of the required manufacturing steps. The CoO of the CMP process is one of the highest CoO figures in the 500 to 800 individual manufacturing steps required to make a semiconductor "chip" and its associated digital device.

While carrier designs incorporating various embodiments of resilient membrane concepts work well in terms of uniform material removal, there remain some non-optimum characteristics in their typical process performance. Essentially, despite substantial efforts to minimize them, certain practical deficiencies and anomalies still exist, which cause non-uniform pressure application to the wafer and associated non-uniform material removal.

Such anomalies include, but are not necessarily limited to, the following: variations in membrane thickness across the membrane; variations in tension across the membrane; and variations in flatness of any rigid components contacting the membrane.

In order to reduce the presence, magnitude and effects of such anomalies, the present application discloses embodiments of systems, apparatus and methods that implement a planarized membrane for use in a substrate carrier for a CMP apparatus. These improve the flatness tolerances and substrate surface quality, when implemented in a CMP apparatus, resulting in increased yield and decreased CoO. It will be understood that although embodiments of the planarized membranes described herein are disclosed within the context of CMP equipment, they can be similarly implemented within other applications.

Detailed embodiments of the present invention will now be described with reference to the drawings.

FIG. 1 is a schematic illustration of a chemical mechanical planarization system 100 for treating a polishing pad 110. System 100 can include a wafer carrier 150 configured to hold and process a wafer. It will be understood that the term "wafer" as used herein may refer to a circular, semiconductor wafer, but can more broadly encompass other types of substrates with different shapes which are processed by CMP equipment. In the illustrated embodiment, the wafer carrier 150 is in a processing (e.g., lower) position, holding the wafer (not shown) against a polishing pad 110 with a membrane (not shown). The polishing pad 110 can be positioned on a supporting surface, such as a surface of a platen 120.

Figure 2:
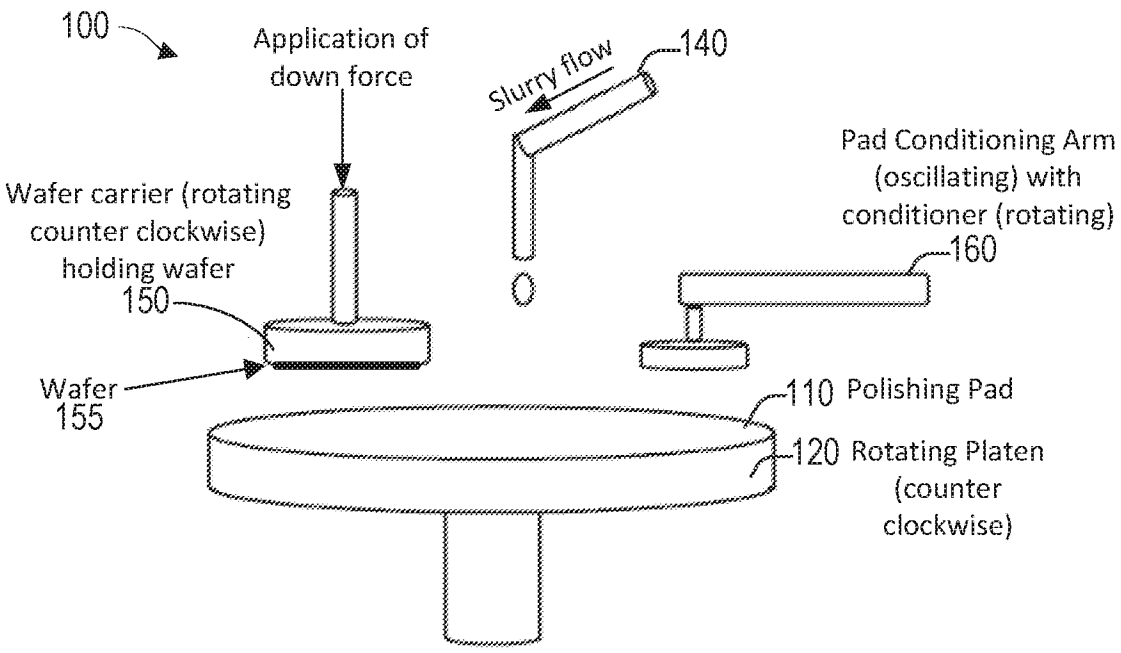
FIG. 2 is a view of the chemical mechanical planarization system of FIG. 1, showing the substrate carrier holding the substrate in a loading position.

FIG. 2 is a view of the chemical mechanical planarization system of FIG. 1, showing a wafer 155 held by the wafer carrier 150 in a loading (e.g., upper) position. The wafer 155 can be held, for example, by force of a vacuum. Referring to both FIGS. 1 and 2, system 100 can include a slurry delivery system 140 configured to deliver the processing slurry to the wafer 155, and allow it to be chemically/mechanically planarized against the polishing pad 110. System 100 can include a pad conditioning arm 160, which includes a pad conditioner at its end, which can be configured to treat or "refresh" the surface roughness, or other processing characteristics of the pad, during or between processing cycles.

In the system 100 of FIGS. 1 and 2, polishing pad 110 is on the top surface of platen 120 which rotates counter clockwise about a vertical axis. Other orientations and directions of movement can be implemented.

The slurry delivery system 140 can deliver a slurry containing sub-micron abrasive and corrosive particles to a surface of the treated polishing pad 130. The polishing slurries are typically colloidal suspensions of abrasive particles, i.e. colloidal silica, colloidal alumina, or colloidal ceria, in a water based medium. In various embodiments, the slurry delivery system 140 includes a metering pump or a mass-flow-control regulator system, or other suitable fluid delivery components.

The wafer carrier 150 can hold wafer 155, for example, with a vacuum, so that the surface of the wafer 155 to be polished faces towards polishing pad 110. Abrasive particles and corrosive chemicals in the slurry deposited by the slurry delivery system 140 on the polishing pad 110 mechanically and chemically polish the wafer through abrasion and corrosion, respectively. The wafer carrier 155 and polishing pad 110 can move relative to each other in any of a number of different ways, to provide the polishing. For example, the wafer carrier can apply a downward force against the platen 120 so that the wafer 155 is pressed against the polishing pad 110. The wafer 155 can be pressed against the polishing pad 110 with a pressurized membrane (not shown), as will be described further herein. Abrasive particles and corrosive chemicals of the slurry between the wafer 155 and the polishing pad 110 can provide chemical and mechanical polishing as the polishing pad 110 and wafer carrier 155 move relative to each other. The relative motion between polishing pads and wafer carriers can be configured in various ways, and either or both can be configured to oscillate, move linearly, and/or rotate, counter clockwise and/or clockwise relative to each other.

Pad conditioning arm 160 conditions the surface of polishing pad 110, by pressing against polishing pad 110 with a force, with relative movement therebetween, such as the relative motion described above with respect to the polishing pad and wafer carrier 150. The pad conditioning arm 160 in the illustrated embodiment can oscillate, with a rotating pad conditioner at its end, which contacts the polishing pad 110.

Figure 3:
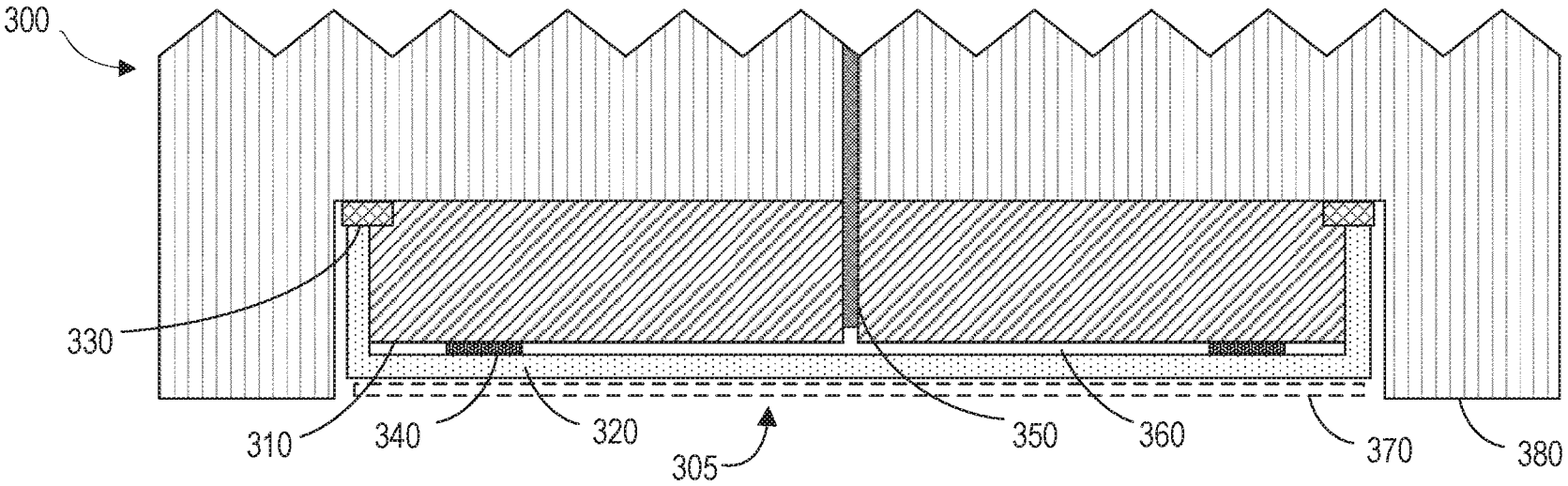
FIG. 3 is a partial cross-sectional view of an example carrier head assembly which includes an embodiment of a membrane assembly for use in chemical mechanical planarization systems.

FIG. 3 is a partial cross-sectional view of a carrier assembly 300 which includes an embodiment of a membrane assembly 305 for a chemical mechanical planarization (CMP) system. In some embodiments, the carrier assembly 300 may include a support base 380 to which the membrane assembly 305 is mounted. The support base 380 can be any suitable configuration configured to provide support to the membrane assembly. The support base 380 can attach and interface the remainder of the carrier assembly 300 with a CMP system (not shown).

The membrane assembly 305 may include a support plate 310, a resilient membrane 320, a membrane clamp 330, and an outer pressure ring 340, as shown. The support plate 310 can be any suitable configuration to attach membrane assembly 305 to support base 380. For example, the support plate 310 may be mounted to the support base 380 using one or more bolts or other suitable attachment elements. The support plate 310 may be mounted to the support base 380 at various locations, such as along the outer perimeter of the support base 380.

The support plate 310 can be any suitable configuration to support the resilient membrane 320. The resilient membrane 320 may be secured to the support plate 310 in a number of different ways. The resilient membrane 320 may be secured to the support plate 310 before or after the support plate 310 is secured to the support base 380. The resilient membrane 320 may be secured to the support plate 310 through use of any of a number of suitable different holding elements, such as the membrane clamp 330. In some embodiments, the membrane clamp 330 may be spring loaded. In other embodiments, the membrane clamp 330 may tighten securely through the use of a fastening mechanism (e.g., nuts and bolts, etc.).

The resilient membrane 320 can be secured to the support plate 310 such that the membrane 320 can hold a wafer 370 against a polishing pad and process the wafer, for example, as described above with reference to FIGS. 1-2. The membrane 320 can be sufficiently resilient and flexible, such that in combination with the polishing pad materials and process parameters, wafer breakage is reduced. The membrane 320 and support plate 310 can be configured to allow gas pressure between the membrane 320 and support plate 310, and press the membrane 320 against the wafer 370 during planarization. For example, a substantial seal can be formed between the membrane 320 and plate 310. The support plate 310 can be spaced from the membrane 320, to form a gap or cavity 360 therebetween. The cavity 360 can be formed when the membrane 320 is in a quiescent (e.g., non-pressurized) state. In some embodiments, the membrane 320 rests upon or proximate to the plate 310 when the membrane 320 is in a quiescent state, and the cavity 360 is formed when the membrane 320 is expanded (e.g., pressurized). The cavity 360 can redistribute and account for variations in the gas pressure against the membrane 320, and thus, against the wafer 370, during planarization. The gas pressure can be provided to the backside of the membrane 320 through a pneumatic channel 350, as shown. The pneumatic channel 350 may be disposed within the support plate 310, or can supply gas through other configurations. The pneumatic channel 350 may be modified differently depending on the application (e.g., a circular tube, a square tube, etc.). In some embodiments, the pneumatic channel may provide vacuum for retaining a wafer 370 to the underside of the membrane assembly. The membrane 320 may include holes, to either provide such vacuum, and/or allow for positive pressure to disengage the wafer 370 from the membrane 320.

In some embodiments, the cavity 360 can be formed by spacing the membrane 320 from the support plate 310. For example, the support plate 310 can included a recessed inner portion to form a cavity. In the illustrated embodiment, the membrane assembly 305 can include an outer pressure ring 340 to form the cavity 360. In other embodiments, the membrane assembly may be assembled without pressure rings. For example, the membrane 320 may rest directly against the support plate 310 without a cavity 360 separating the membrane 320 from the support plate 310. In some embodiments, the membrane assembly may include one or more pressure rings 340 arranged in concentric circles.

In another embodiment, the membrane 320 used may be a multi-zoned membrane. For example, the membrane 320 may have grooves (e.g., indentations) and/or raised portions of the membrane 320 that effectively segregate various zones of the membrane 320. In a non-limiting example, the grooves may be arranged in a series of concentric circles originating from the center of the membrane. In another example, the grooves and raise portions may be irregularly shaped (e.g., interconnecting circles, non-circular indentations, circular patterns scattered across the surface of the membrane) in order to improve distribution of pressure applied across the wafer 370 when attached to the membrane assembly.

The membrane 320 may be flexible such that it conforms to a structure that it surrounds. In some instances, the membrane 320 may be convex. For example, the membrane 320 may sag in the center. The membrane 320 may even be shaped like a cone such that a small area of the membrane 320 would be in contact with the wafer surface for finer precision polishing.

The membrane material may be any resilient material suitable for planarization, as described herein, and for use, for example, within a carrier head for a CMP process. In some embodiments, the membrane material may be one of rubber or a synthetic rubber material. The membrane material may also be one of Ethylene propylene diene monomer (M-class) (EPDM) rubber or silicone. Alternatively, it may be one or more combinations of vinyl, rubber, silicone rubber, synthetic rubber, nitrile, thermoplastic elastomer, fluorelastomers, hydrated acrylonitrile butadiene rubber, or urethane and polyurethane formas.

One or more membrane assemblies can be implemented within a single CMP system. The CMP system may have controls utilizing feedback from the system while operating to more accurately control the CMP process (e.g., variable speed motor controls, etc.).

In an exemplary embodiment, the membrane 320 may be planarized. For example, the membrane 320 can be made flat within a desired tolerance, and/or made to conform to a surface roughness within a desired tolerance. For example, the membrane 320 may undergo a planarization procedure wherein the membrane is subjected to a polishing pad. In addition, the membrane 320 may be introduced to a chemical slurry that causes the membrane 320 to become planarized. Furthermore, the surface roughness of the membrane 320 can be improved throughout this planarization process. Surface roughness can be important for membranes used within the context of a CMP process for at least two reasons: sealing and stiction. Through the planarization process, the surface roughness may be lowered in order to provide improved sealing between the wafer 370 and the membrane 320 for handling purposes. At the same time, the surface roughness may be increased in order to prevent stiction (i.e., the wafer sticking to the membrane from surface tension), and improve wafer release from the membrane after processing. Control mechanisms may be used during the planarization process (described below) in order to achieve a desired balance between low and high surface roughness. The control mechanism may be external to the device used to planarized the membrane.

A specialized tool or device may be used to planarize a membrane 320. For example, a conditioning tool 400 (described in reference to FIG. 4) may be used to planarize the surface of a resilient membrane prior to the membrane being used in a CMP process. This device may be configured to planarize one or more membranes in a single planarization cycle. This cycle may be repeated one or more times before the membrane is sufficiently planarized. Alternatively, the membrane may be planarized after one continuous cycle. In one example, the conditioning tool may utilize feedback control loops to more accurately control the membrane planarization process (e.g., variable speed motor controls, etc.).

In some examples, only a portion or section of the surface of the membrane need be planarized. For example, it may be more advantageous to planarize only the outer diameter of the membrane. A single surface or both surfaces of the membrane can be planarized.

Figure 4:
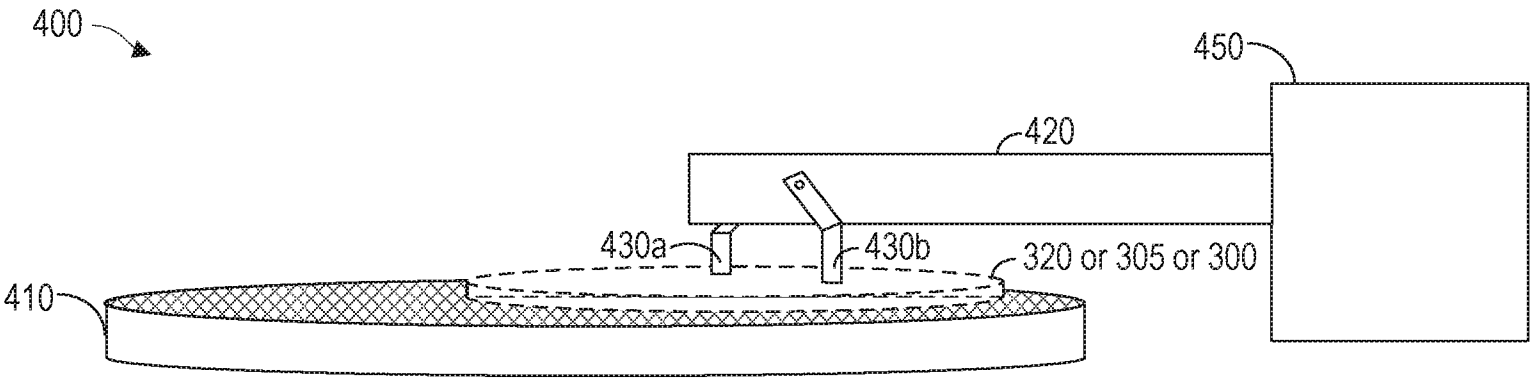
FIG. 4 is a schematic illustration of an example tool used for conditioning the membrane to be used in a chemical mechanical planarization system.

FIG. 4 is a schematic illustration of a membrane conditioning tool 400 that may be used to planarize a surface of a membrane or membrane assembly. The conditioning tool 400 may include any configuration suitable to hold a membrane on a planarizing plate, provide contact and relative motion therebetween, and planarize the membrane.

For example, the conditioning tool 400 may include a plate 410, an arm 420, one or more rollers 430*a*, 430*b*, and a conditioning tool base 450. In an exemplary embodiment, a membrane 320 may be placed on the top surface of the plate 410. The moving contact between the membrane 320 and the plate 410 can provide the planarization to the surface of membrane 320. The planarization can include introducing an abrasive material, such as sand, and/or other chemicals, such as a chemical slurry, to remove material and planarize membrane 320. The planarization can be performed with the membrane 320 pressurized, to press it against the plate 410. Other types of forces can be implemented to press the membrane 320 against the plate 410 and provide planarization. For example, arm 420 and/or plate 410 can move relative to each other to press membrane 320 against the plate 410. The arm 420 and/or plate 410 can be configured in other ways to provide similar function. For example, the arm 420 can be configured similarly to a wafer carrier, and move linearly to provide force between the plate 410 and the membrane 320 for planarization. The plate 410 can include a polishing pad or other components or treatments on its surface to provide planarization to the membrane 320.

The membrane may be secured to the rollers 430*a*, 430*b*, with a fastener (e.g., magnets, screws, bolts, etc.). As shown in FIG. 4, the rollers may comprise one or more rollers. In some examples, there may be additional rollers positioned around the outer edge of the membrane. Alternatively, there may be a single roller that extends from the arm 420 and contacts the outer edge of the membrane on all sides such that multiple rollers would be unnecessary. In some embodiments, the arm 420 may be held stationary within the base 450. In other embodiments, the arm 420 may be actuated by a control mechanism within the base 450. For example, the base 450 may include gears within the base 450 that engage with the arm 420 causing the arm 420 to move before or during the planarization process. The control mechanism may receive information from the system regarding the planar nature of the membrane during the planarization process such that the control mechanism may adjust the speed of the plate 410 or the pressure applied by the arms 430, or other parameters to increase efficacy and efficiency of the system, and to affect the amount of material removal, and/or uniformity of planarization.

In some embodiments, the plate 410 may move (e.g., rotate, orbit, oscillate, reciprocate, etc.) in any way to provide planarization while the membrane 320 is held stationary. In other embodiments, the membrane 320 may be moved while the plate 410 is stationary. In other embodiments, the membrane 320 and the plate 410 may both move to provide relative motion therebetween. The rotating velocity of the plate may be controlled by a variable speed drive which receives input from the system in order to accurately adjust the velocity of the plate in real-time. In another embodiment, the velocity may be kept at a low constant velocity. In addition, the arm 420 may be actionable such that it may apply pressure to the membrane to produce a sufficiently conditioned membrane.

In other embodiments, the membrane may be stretched around the outside of a temporary membrane holder. In some examples, this holder may stretch the membrane such that the membrane body experiences tension before or during the planarization process. In some embodiments, the membrane can be held in place with a membrane assembly that includes additional support components, such as the membrane assembly 305 in FIG. 3. In some embodiments, the membrane can be held in place and pressurized or otherwise held against the plate, similarly to that described with reference to the carrier head(s), polishing pads and membranes in FIGS. 1-3. The membrane may be similarly processed, using similar slurries, chemistries, and polishing pads as described herein with reference to CMP processes. The membrane can be planarized at lower velocities and/or pressures than conventional CMP processes. For example, the membrane may be planarized at a rotational velocity of approximately 10 to 500 Rotations Per Minute (RPM). The membrane may be planarized at a pressure of approximately 0.1 to 10 psi.

A planarized surface is a substantially flat surface (e.g., a planar surface). One method of testing the planarization of a surface is to test the uniformity of the surface such that all points along the surface are on a single two-dimensional plane or within a specified margin of error of the single two-dimensional plane.

The process of planarizing includes conditioning a surface such that it becomes planarized. This may be done, for example, using a polishing pad, wherein polishing is sought that planarizes the membrane surface to a predetermined uniformity over the surface area of the portion of the membrane being planarized. In some embodiments, the approximate thickness of the planarized membrane between a first planarized surface, and a second opposing surface of the membrane is within a range of about 0.005 to 0.100 inches. In some embodiments, the overall thickness of the membrane after it has been planarized is reduced, relative to the thickness of the membrane prior to planarization, by about 10 to 50%. In some embodiments, the planarized membrane comprises a planarized surface with a roughness within a predetermined range. In some embodiments, the roughness of the planarized surface of the planarized membrane may be decreased or increased by some percentage relative to the same surface prior to planarization.

In another example, testing the planarity of a membrane may involve reflecting light off the membrane surface at a known angle and measure whether the light is reflected at the same or substantially the same angle at all points along the surface and how the reflected angle relates to the known angle. For example, an acceptable difference may be within two degrees. Alternatively, the angle may be 0.7-1.0 degrees on average.

It will be understood that embodiments of the planarized CMP membranes described herein can be formed through any of a number of different configurations, and should not be limited to the example shown in FIG. 4. For example, a CMP system might be modified to planarize a CMP membrane, through different processing parameters, such as polishing velocities, pressures, and chemistries, and/or through modified polishing pad compositions and configurations.

Figure 5:
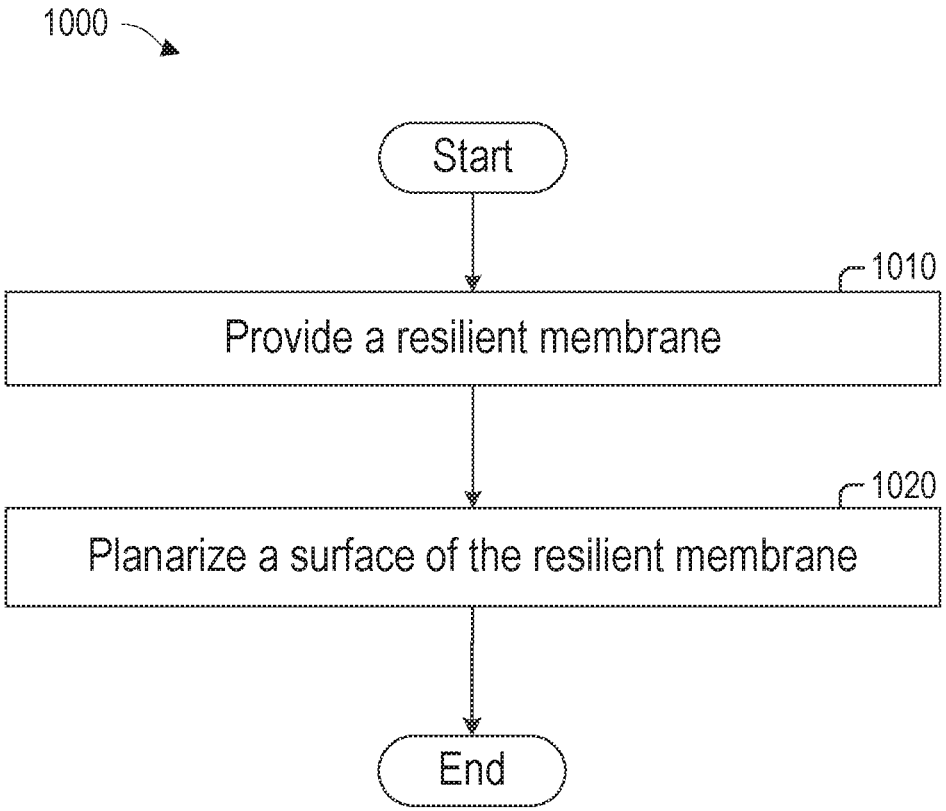
FIG. 5 is a flowchart illustrating an example method for conditioning a membrane through the use of planarization before the membrane is used in planarizing a wafer.

FIG. 5 is a flowchart illustrating an example method 1000 for conditioning a membrane for chemical mechanical planarization. In some aspects, method 1000 may be performed by the system 400 of FIG. 4, or other systems. The method 1000 can be performed on various membranes, or membrane assemblies, such as membrane 320 and membrane assembly 305 (FIGS. 3 and 4).

In block 1010 a resilient membrane is provided. In block 1020, the surface of the membrane provided in block 1010 is planarized. Block 1020 may be performed, for example, by the conditioning tool system 400 (FIG. 4). A resilient membrane planarized by method 1000 can, in some embodiments, be used to treat a wafer surface with the planarized membrane. Additionally, method 1000 can include a step of moving the membrane relative to the tool. Method 1000 can also include a step for cycling the planarization process. Method 1000 can also include a step for controlling the surface roughness of the membrane such that the stiction and sealing are within a desired range. Additionally, Block 1020 may include the step of stretching (e.g., tensioning) the membrane before or during the polishing process. Furthermore, method 1000 can be used to form a planarized membrane that can be implemented within a CMP process to polish a wafer. Such a process can include delivering a slurry containing a CMP-suitable slurry (e.g., with abrasive and corrosive particles) to a surface of the treated polishing pad. The process can further include polishing a wafer with the abrasive and corrosive particles. In one preferred embodiment, such wafer polishing can include using a planarized membrane. In addition, the polishing can include moving a wafer carrier relative to a polishing pad.

It will be understood that the membrane planarization methods and equipment described herein can be implemented without the full CMP systems shown. For example, the membrane may be planarized prior to being brought within the context of the remainder of the CMP systems shown in FIGS. 1 and 2. Additionally, other CMP equipment can implement embodiments of the planarized membrane described herein, including multiple-head CMP systems, orbital CMP systems, or other CMP systems. For example, the membrane planarization treatment methods and equipment described herein can be implemented within sub-aperture CMP systems. A sub-aperture CMP system can include a polishing pad which is smaller in diameter than the wafer. The wafer is typically oriented face-up with slurry dispensed on its surface, while the wafer and pad are rotated and the pad sweeps across the wafer.

Figure 6:
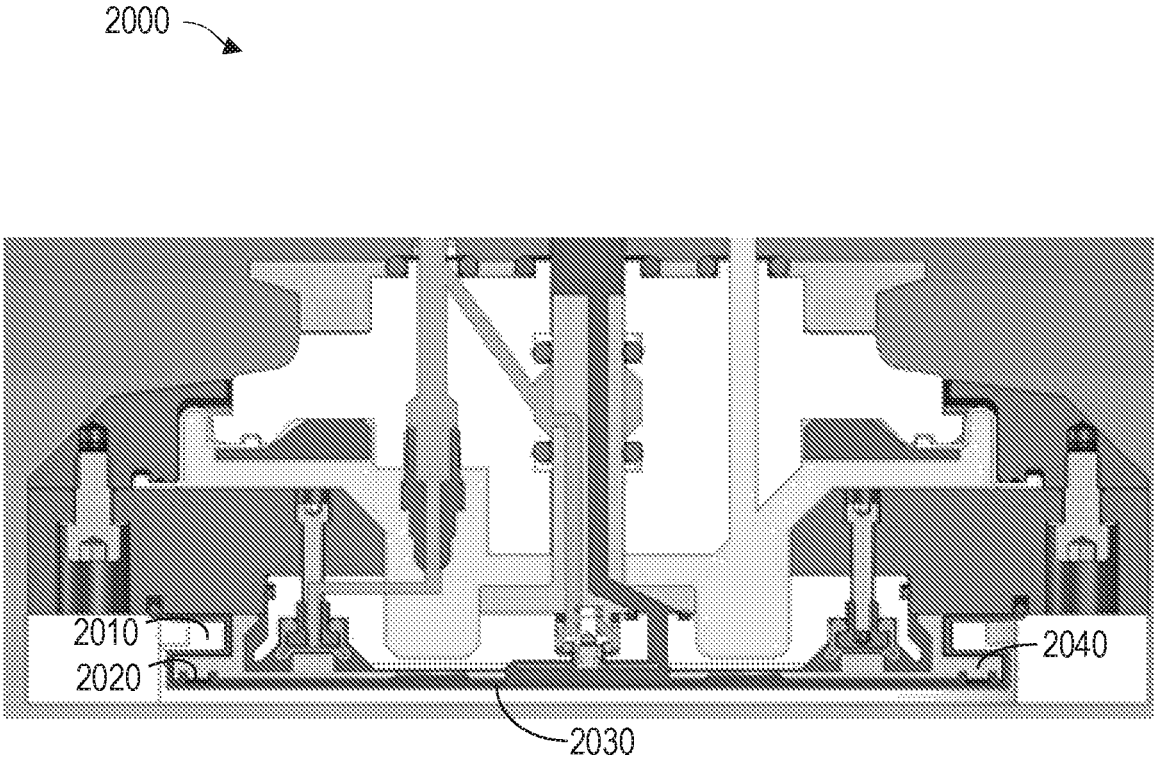
FIG. 6 is an exemplary embodiment of a CMP carrier head.

FIG. 6 is an illustrative cross-section of an example carrier head 2000. The carrier head 2000 may have a membrane clamp 2010, an outer pressure ring 2020, a planarized membrane 2030, and a support plate 2040. For example, the planarized membrane may be secured in place by the membrane clamp 2010. The carrier head may include all or some of the features described with reference to FIG. 3 (e.g., support plate, pneumatic channel, etc.). In addition, the carrier head 2000 may have an air cavity formed between the support plate 2040 and the membrane 2030 due to the outer pressure ring 2020. The width of the cavity may be based at least in part on the thickness of the outer pressure ring 2020 when the system is not pressurized. In the example of FIG. 6, the air cavity is shown in red. This cavity may shrink in size when the system is pressurized depending on the amount vacuum pressure is provided through, for example, a pneumatic channel. The carrier head may include one or more bladders (shown in orange). In one embodiment, the bladder may be inflatable or flexible such that it may expand and apply a uniform pressure to the wafer for polishing.

Another aspect of the present disclosure can include planarizing one or more of the components that support the resilient membranes described herein. For example, some embodiments can include methods of planarizing the supporting ring, such as the outer pressure ring 2020. The outer pressure ring may be made from poromeric urethane, or other suitable materials such as Eminess DF200 or WB20. Some materials used to form the pressure ring may exhibit imperfections, such as variations in thickness and/or local compressibility. In addition, the surface to which the outer pressure ring 2020 is mounted may have similar anomalies, such as out-of-flatness condition and/or surface defects (e.g., bumps, pits, etc.). Such imperfections can transfer a non-uniform application of pressure through the membrane to the substrate. As such, the outer pressure ring 2020 may be planarized before or after being applied to the support plate 2040. It will be understood that the rotational speeds and pressures for such planarization of the outer pressure ring 2020 may be in a similar range as would be used for a membrane.

EMPIRICAL DATA

Evidence has been obtained to demonstrate the improved non-uniformity of a wafer that may result through use of a planarized wafer carrier membrane. In one demonstration, the improved non-uniformity was especially apparent near the edge of the wafer. In that demonstration, a modified 150 mm Titan polishing head was used. The results of that demonstration are shown in FIGS. 7-8.

Figure 7A:
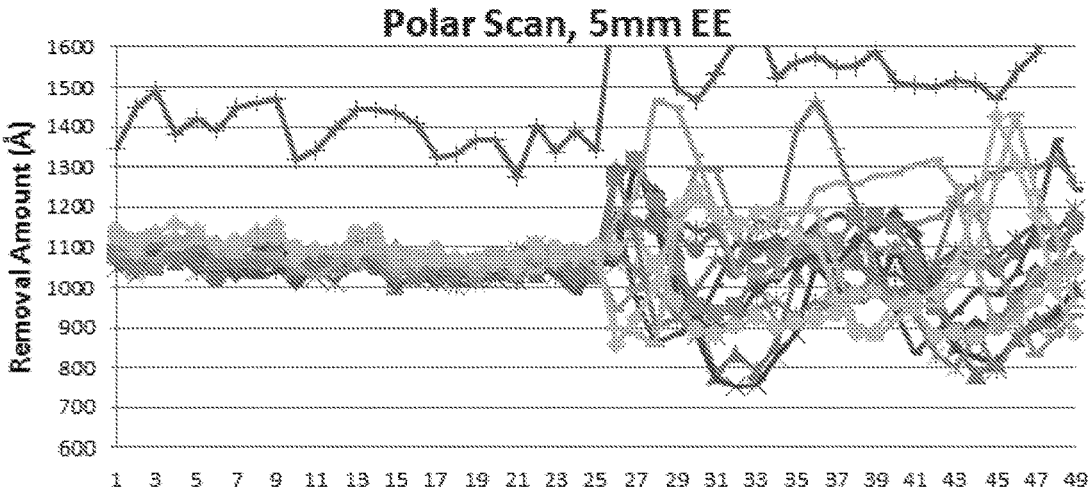
FIGS. 7*a*, 7*b* and 8 provide results obtained from a demonstration involving planarized membranes, as described herein.
Figure 7B:
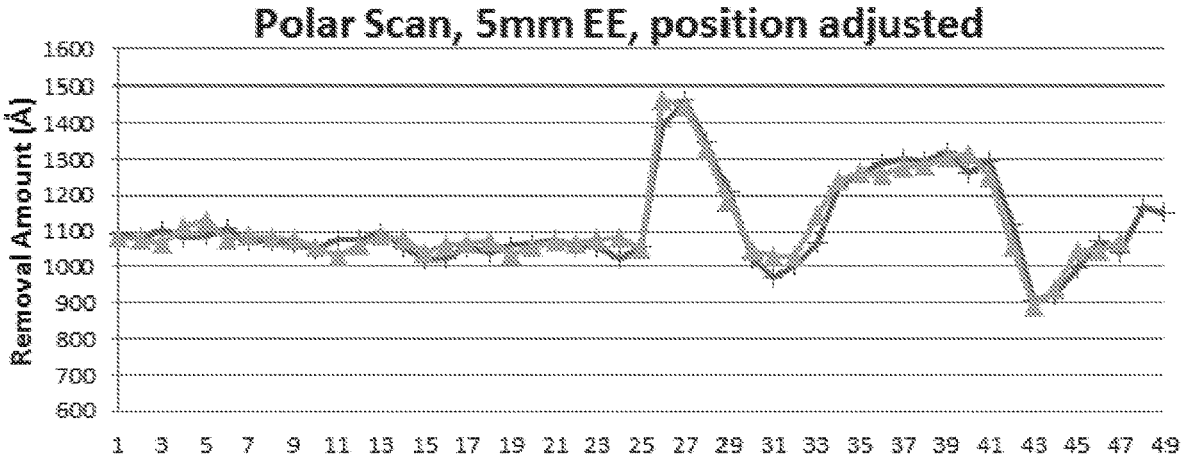

As shown in FIG. 7*a*, the symptoms are a non-symmetric diameter scan and a corresponding poor polar scan of the same wafer. When the wafers are clocked to the same location on the head, the profiles have a repeating pattern. For example, FIG. 7*b* shows the repeating pattern when the poles of two wafers were "rotated." This demonstrates the improvement of the substrate planarization process using a planarized membrane as described herein.

Figure 8:
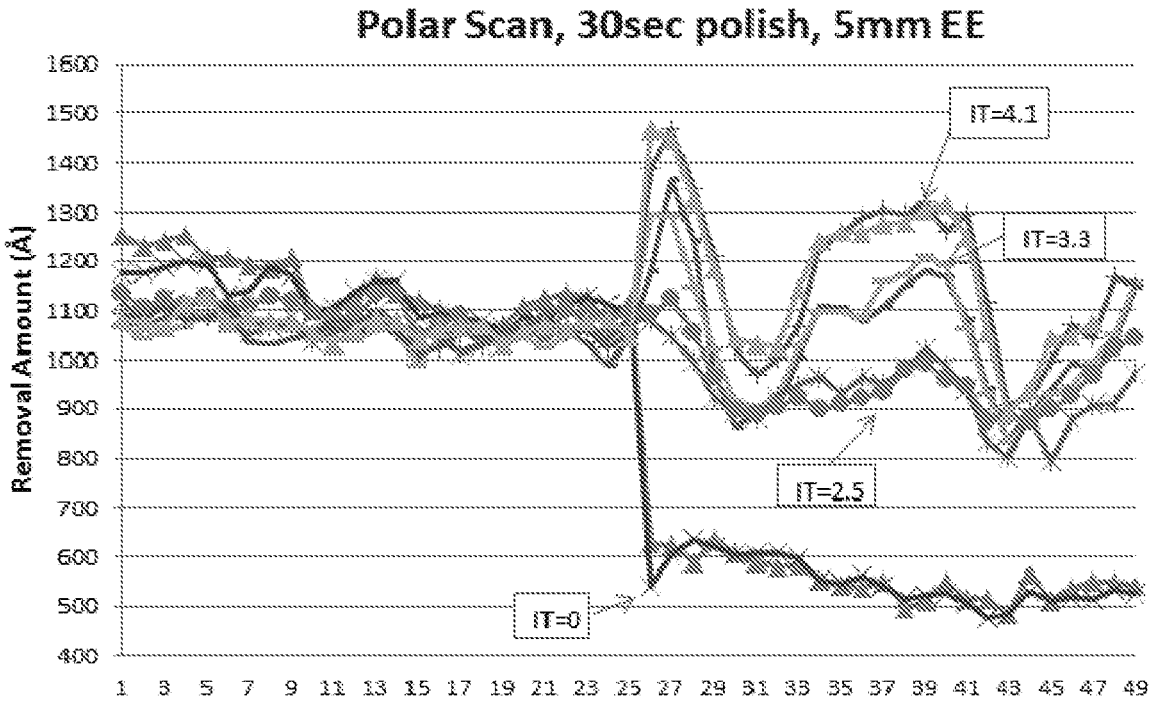

Additionally, as shown in FIG. 8, the pressure applied during the membrane planarization process has a significant effect on the efficacy of the process itself. For example, in reference to FIG. 8, when the plate pressure was reduced to 0, the slow edge of the wafer was identical to the standard carrier head. On the other hand, when the pressure was increased, the amplitude of the edge effect increased.

What is claimed is:

1. A method for processing a resilient membrane for a substrate carrier, the method comprising:
- providing the resilient membrane;
- planarizing a surface of the resilient membrane by a membrane conditioning tool to form a planarized resilient membrane;
- providing a support plate to support the membrane; and
- providing a holding element to hold the membrane to the support plate.

2. The method of claim 1, wherein the planarizing is performed with the membrane attached to a membrane assembly comprising a support plate and a holding element.

3. The method of claim 2, wherein the membrane surface is planarized using an abrasive material.

4. The method of claim 3, wherein the abrasive material is sand.

5. The method of claim 3, wherein planarizing further comprises introducing one or more chemicals to the surface of the resilient membrane.

6. The method of claim 5, wherein the one or more chemicals comprise a chemical slurry mixture.

7. The method of claim 6, wherein planarizing comprises controlling a relative rotation velocity between a plate and the membrane with respect to each other.

8. The method of claim 7, wherein the rotation velocity is approximately 10 to 500 rotations per minute.

9. A method of planarizing a substrate, comprising:
- providing the substrate;
- providing a CMP system including a planarized membrane formed with the method of claim 1; and
- planarizing a surface of the substrate.

10. An apparatus for supporting a substrate, comprising:
- a membrane comprising a planarized surface, wherein the membrane is planarized by a membrane conditioning tool to reduce a surface roughness of the membrane;
- a support plate configured to support the membrane; and
- a holding element configured to hold the membrane to the support plate.

11. The apparatus of claim 10, further comprising a cavity between the support plate and the membrane.

12. The apparatus of claim 11, further comprising a ring positioned between the support plate and the membrane and forming an outer perimeter with respect to the cavity.

13. The apparatus of claim 12, wherein the ring comprises a planarized surface.

14. A substrate carrier comprising the apparatus of claim 13.

15. A membrane for chemical mechanical planarization, comprising:

a resilient membrane body comprising a substrate facing surface and a carrier facing surface, wherein the substrate facing surface is planarized to have a surface roughness within a predetermined range that increases sealing between the membrane and a wafer.

16. The membrane of claim 15, wherein the thickness between the planarized substrate facing surface and the carrier facing surface is within a range of approximately 0.005 to 0.100 inches.

17. A system for planarizing the membrane of claim 15, comprising a membrane conditioning tool.

18. The system of claim 17, comprising a controller configured to planarize the membrane at a pressure within a range of approximately 0.1 to 10 psi.

19. The system of claim 17, wherein the surface roughness of the planarized substrate facing surface is substantially uniform over the surface of the resilient membrane body.

20. The apparatus of claim 10, wherein the predetermined range for the surface roughness of the planarized surface of the membrane substantially prevents the wafer from sticking to the planarized surface from surface tension.

21. The apparatus of claim 10, wherein an outer diameter of the planarized surface has a lower surface roughness than an inner diameter of the planarized surface.

22. The apparatus of claim 10, wherein the planarized surface of the membrane has a planarity which, when measured by reflecting light off of the planarized surface at a first angle, a range of second angles of the reflected light are within two degrees of each other.

23. The apparatus of claim 22, wherein the range of the second angles of the reflected light are within 0.7-1.0 degrees of each other.

24. The apparatus of claim 10, wherein the surface roughness of the planarized membrane is below a threshold value, and wherein the threshold value is selected such that planarization of the wafer held adjacent to the membrane has a lower non-uniformity after chemical mechanical planarization compared to planarization with a comparative membrane that has not been planarized by the membrane conditioning tool.

25. The apparatus of claim 10, wherein the planarized surface has a surface roughness within a predetermined range that increases sealing between the membrane and a wafer.

26. A membrane for chemical mechanical planarization, comprising:

a resilient membrane body comprising:

a planarized substrate facing surface with a substrate surface roughness; and a carrier facing surface, with a carrier surface roughness, wherein the substrate surface roughness is less than the carrier surface roughness.

* * * * *